US005083906A

United States Patent [19]

Du

[11] Patent Number: 5,083,906

[45] Date of Patent: Jan. 28, 1992

[54] FLUID PUMP

[76] Inventor: Benjamin R. Du, 32392 Via Antibes, South Laguna, Calif. 92677

[21] Appl. No.: 580,962

[22] Filed: Sep. 11, 1990

[51] Int. Cl.[5] ..... F04B 43/06

[52] U.S. Cl. ..... 417/395; 417/392; 91/346

[58] Field of Search ..... 417/395, 392; 91/346

[56] References Cited

U.S. PATENT DOCUMENTS

| | | | |
|---|---|---|---|
| 3,268,271 | 8/1966 | Yackle | 91/346 |
| 3,699,846 | 10/1972 | Stomper | 91/346 |
| 4,551,076 | 11/1985 | DuBois | 417/395 |
| 4,681,518 | 7/1987 | Credle, Jr. | 417/395 |
| 4,828,465 | 5/1989 | Credle, Jr. | 417/395 |
| 4,923,168 | 5/1990 | Murata et al. | 91/346 |
| 5,002,469 | 3/1991 | Murata et al. | 91/346 |

*Primary Examiner*—Richard A. Bertsch

*Assistant Examiner*—Michael I. Kocharov

*Attorney, Agent, or Firm*—Stetina and Brunda

[57] ABSTRACT

This invention relates to an improved gas-driven pump for pumping products, such as beverage syrups. A piston is mounted to a piston shaft for reciprocal movement within a housing. Cavities corresponding to the piston are alternately vented and pressurized to intake the product into a first chamber and to drive the piston to pump the product. A valve stem is included within the housing and is adapted such that the piston performing intake and exhaust strokes moves the valve stem between intake and exhaust positions. A valve body is disposed about the valve stem which is also movable between two positions for alternately venting and pressurizing a second chamber. The valve stem which is operable to move the valve body is biased toward the intake or exhaust position by an overcenter spring disposed within the second chamber.

8 Claims, 2 Drawing Sheets

FLUID PUMP

FIELD OF THE INVENTION

The present invention relates generally to pumps and more particularly to an improved gas driven pump apparatus and method for pumping a product, such as a beverage syrup used in carbonated beverages, from a bag-in-box storage container, wherein the pumping apparatus provides a constant, low flow rate without mixing air or other impurities into the product being pumped.

BACKGROUND OF THE INVENTION

As is well known, a variety of beverages are marketed to retail consumers by dispensing systems which simultaneously deliver a metered quantity of flavored syrup with a proportional quantity of carbonated water or the like. For sanitation and economic concerns, the beverage industry typically supplies these flavored syrups in collapsible bag-in-box containers which are adapted to be connected to suitable prior art dispensing systems.

The majority of prior art dispensing systems have utilized low flow rate pumps for drawing the syrup from the bag container and supplying a metered quantity of syrup to a mixing nozzle. The use of such low flow rate pumps has been advantageous for system reliability concerns. The syrups are normally concentrated and are mixed with relatively large volumes of carbonated water which means that undesired small variations in the quantity of syrup supplied will produce wide variations in the taste and quality of the final mixed product. Although prior art dispensing systems have generally proven suitable for their intended purposes, they possess inherent deficiencies which have detracted from their overall effectiveness and use in the trade. Foremost of these deficiencies has been the relatively high cost of the pumping mechanism as well as the inability of most of the prior art dispensing systems to eliminate the ingestion of air into the pump and then mixing the air with the product being dispensed. Inducing air into the dispensing system typically occurs when the pump encounters a syrup depletion condition within the syrup bag-in-box container. As will be recognized, air ingestion into the dispensing system necessarily introduces inaccuracy in the quantity of dispenser syrup and thus adversely affects the quality of the resultant beverage. In extreme cases, air ingestion causes overheating and permanent damage to the pump of the dispensing system. Although these air ingestion deficiencies have been recognized to a limited extent, the solutions to date have typically been ineffective or have used devices so complicated that they are excessively expensive and unreliable.

Thus, there exists a substantial need in the art for a reliable, relatively inexpensive apparatus and method for dispensing syrup at a low flow rate suitable for properly dispensing the syrup through a nozzle and which prevents air ingestion into the dispensing system.

SUMMARY OF THE INVENTION

The present invention overcomes the difficulties associated with prior art food and beverage product distributing pumps. In accordance with a preferred embodiment of the present invention, there is provided a simplistic design, relatively low cost, fluid-driven pump which generally comprises a housing defining a first chamber and a second chamber. A piston which is mounted to the first end of a piston shaft is slidably positioned within the housing. The piston is reciprocally movable through intake and exhaust strokes within the first chamber for pumping a product therefrom. The second chamber is alternately supplied with a pressurized fluid, such as carbon dioxide gas, and vented to ambient air to accomplish the desired pumping action. The housing further includes a product inlet which is in fluid communication with the first chamber during intake strokes of the piston and a product outlet which is in fluid communication with the first chamber during exhaust strokes of the piston.

Application and venting of pressurized gas to the second chamber to move the piston is controlled by a valve assembly disposed within the second chamber. The valve assembly includes a reciprocable valve stem having an aperture extending longitudinally therethrough for slidably receiving the piston shaft. A valve body is slidably mounted along the length of the valve stem and is used for alternately pressurizing and venting the second cavity. The valve body includes a first passage therein for placing the second chamber in communication with ambient air. A valve member is also disposed within the second chamber which is adapted to receive one end of the valve body. The valve member includes a second passage therein for placing the second chamber in communication with pressurized gas. In the preferred embodiment, the valve body is movable between a first position and a second position to selectively place the first and second passages in communication with the pressurized fluid and ambient air. An over-center spring, i.e. torsion bar, assembly is also disposed Within the second chamber and cooperates with the valve stem for biasing the valve stem toward an intake position during an intake stroke of the piston. Importantly, the over-center spring reverses direction and biases the valve stem to an exhaust position as the piston moves through an exhaust stroke. In the preferred embodiment, the over-center spring assembly comprises a U-shaped, torsion bar spring extending from the valve member to the valve stem.

As previously specified, the valve body is movable to selectively place the first and second passages in communication with the pressurized fluid and ambient air. In this regard, the valve body is operable to pressurize the second chamber when in the first position and vent the second chamber when in the second position. Additionally, both the top end and bottom end of the valve stem include projections which are adapted to engage and move the valve body in unison with the valve stem. In the preferred embodiment, the valve stem is movable a first selected distance during an exhaust stroke of the piston without moving the valve body. After the valve stem has moved the first selected distance, the over-center torsion bar spring assembly biases the valve stem toward the exhaust position, the valve stem being operable to move the valve body to the second position when biased toward the exhaust position. Similarly, the valve stem is also movable a second selected distance during an intake stroke of the piston without moving the valve body. In this regard, after the valve stem has moved the second selected distance the over-center torsion bar spring assembly biases the valve stem toward the intake position, the valve stem being operable to move the valve body to the first position when biased toward the intake position. The piston further includes a rolling diaphragm associated therewith for providing a seal between the first and second chambers.

It is an object of the present invention to provide a pump for dispensing syrup at a low flow rate suitable for properly dispensing the syrup through a nozzle.

Another object of the present invention is to provide a pump which prevents air ingestion into the dispensing system.

A further object of the present invention is to provide a pump which is economical and relatively mechanically simple compared to previous food product pumping devices, and is highly reliable in long-term continuous operation.

Further objects and advantages of the invention will become apparent to those skilled in the art upon reading and consideration of the following description of a preferred embodiment and the accompanying drawings.

BRIEF DESCRIPTION OF THE DRAWINGS

These as well as other features of the present invention will become apparent upon reference to the drawings wherein.

DETAILED DESCRIPTION OF THE PREFERRED EMBODIMENT

Figure 1:
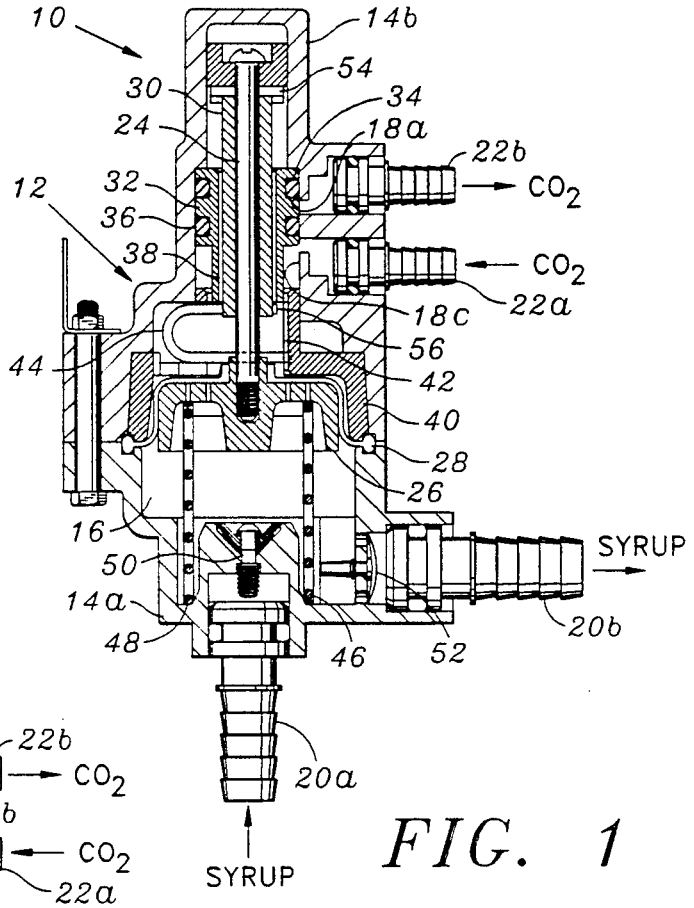
FIG. 1 is a cross-sectional view of the pump of the present invention, illustrating the piston in the full intake position.
Figure 2:
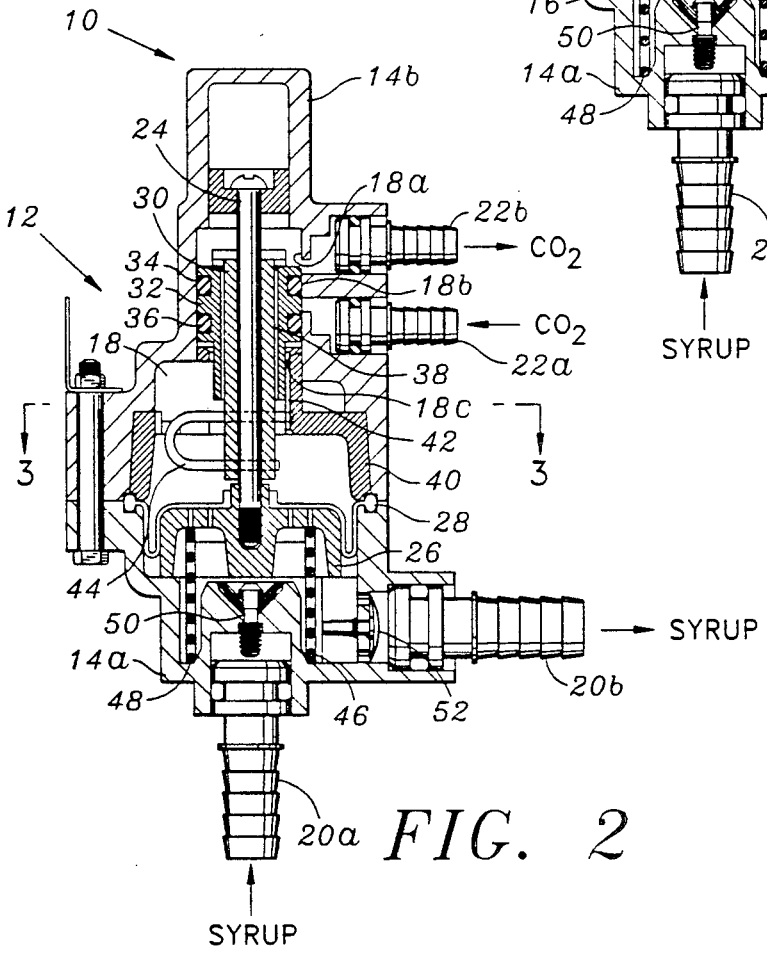
FIG. 2 is a cross-sectional view of the pump of the present invention, illustrating the piston in a full exhaust position.

Referring now to the drawings wherein the showings are for purposes of illustrating a preferred embodiment of the present invention and not for purposes of limiting the same, FIGS. 1 and 2 illustrate cross-sectional views of the fluid-driven pump 10 of the present invention. Pump 10, according to the present invention, includes a pump housing 12 generally consisting of a first housing section 14*a* and a second housing section 14*b*. Defined within first housing section 14*a* is a first chamber 16 and defined within second housing section 14*b* is a second chamber 18. First housing section 14*a* further includes a product inlet 20*a* and a product outlet 20*b*. Similarly, second housing section 14*b* includes a gas inlet 22*a* and a gas outlet 22*b*. The pump housing 12 is formed of first section 14*a* and second section 14*b* for ease of manufacture and assembly of components, and further for convenience of inspection, cleaning, and maintenance of pump 10. Disposed within second housing section 14*b* is a piston shaft 24 which is adapted to be reciprocally movable therein. Attached to the lower end of piston shaft 24 is a piston 26 which is positioned within first housing section 14*a* so as to be in axial alignment with first chamber 16. Piston 26 is reciprocally movable through intake and exhaust strokes within first chamber 16 so as to be operable to pump a product therefrom. In this respect, in FIG. 1 piston 26 is shown at the inner limit (i.e. full intake stroke) of its range of motion while in FIG. 2 piston 26 is shown at its outer limit (i.e. full exhaust stroke) of its range of motion. When piston 26 moves towards its inner position, fluid enters the product inlet 20*a* and subsequently first chamber 16. When piston 26 moves towards its outer position, the fluid is pushed by piston 26 through product outlet 20*b*. A rolling diaphragm 28 is positioned between first housing section 14*a* and second housing section 14*b* which is adapted to move with piston 26 as piston 26 reciprocates relative to pump housing 12.

Also disposed within second chamber 18 is an elongate, reciprocable valve stem 30 having an aperture extending longitudinally therethrough which is sized and configured to slidably receive piston shaft 24. A valve body 32 is slidably mounted along the length of valve stem 30 and is operable to alternately pressurize and vent second cavity 18. Valve body 32 defines first and second annular grooves disposed about the periphery thereof into which are placed a first O-ring 34 and a second O-ring 36. Valve body 32 further defines a first gas passage 38 therein for placing second chamber 18 in communication with ambient air by way of outlet 22*b*. A valve member 40 is also provided within second chamber 18 which is adapted to received the lower end of valve body 32. Importantly, valve member 40 defines a second gas passage 42 therein for placing second chamber 18 in communication with pressurized fluid entering housing 12 through inlet 22*a*. In the preferred embodiment of the present invention, valve body 32 is movable between a first position and a second position to selectively place first passage 38 in communication with pressurized gas and second air passage 42 in communication with ambient air.

Figure 3:
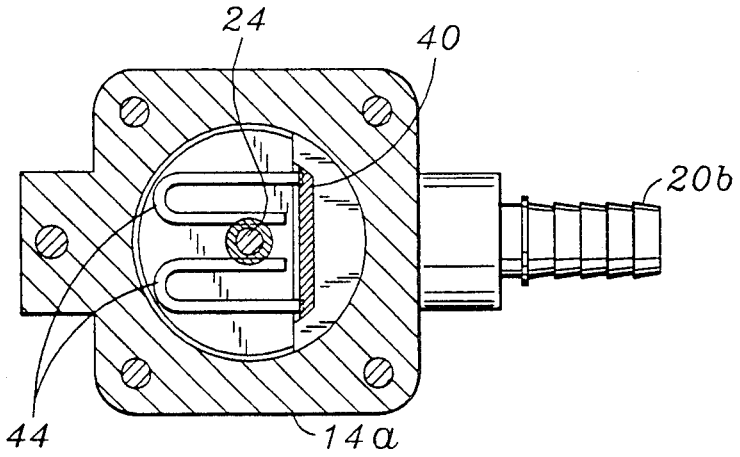
FIG. 3 is a cross-sectional view taken along line 3—3 of FIG. 2, particularly illustrating the engagement of the over-center spring to the valve stem and valve member.

Disposed within second chamber 18 is one or more over-center springs 44. As best seen in FIG. 3, over-center springs 44 are secured Within second chamber 18 through the attachment of over-center springs 44 to valve member 40. Importantly, over-center springs 44 cooperates with valve stem 30 and are operable to bias valve stem 30 toward an intake position as piston 26 travels through an intake stroke. Additionally, over-center springs 44 are operable to reverse direction and bias valve stem 30 toward an exhaust position as piston 26 travels through an exhaust stroke. As will be explained in greater detail below, the movement of valve stem 30 between the intake and exhaust positions is operable to move valve body 32 between its first and second positions. In this respect, valve body 32 is adapted to pressurize second chamber 18 when in the first position and vent second chamber 18 when in the second position. In the preferred embodiment of the present invention, each of the over-center springs 44 comprises a U-shaped torsion bar spring extending from valve member 40 to valve stem 30, though it will be appreciated that other spring configurations may be utilized.

A first biasing spring 46 is additionally provided which is disposed within first chamber 16 and extends axially therein such that the upper end of spring 46 is abutted against piston 26 while the lower end of spring 46 is abutted against a lip 48 formed within first chamber 16. Importantly, spring 46 is operable to bias piston 26 toward second chamber 18 when second chamber 18 is being vented. As previously specified, first housing section 14*a* includes a product inlet 20*a* and a product outlet 20*b* formed therein. In this regard, also disposed within first chamber 16 is an inlet check valve 50 and an umbrella outlet check valve 52, both of which are used to regulate syrup flow into and out of first chamber 16.

Pump Operation

During operation of pump 10, a pressurized gas, such as carbon dioxide, enters inlet 22*a* and subsequently passes through second passage 42 thereby pressurizing second chamber 18. When second chamber 18 is pressurized, gas contacting the top surface 28*a* of diaphragm 28 serves to apply a downward force to piston 26 thus initiating an exhaust stroke thereof. As best seen in FIG. 1, when gas is entering inlet 22*a*, outlet 22*b* is blocked by valve body 32. In this respect, such blockage is facilitated by the sealing of first O-ring 34 and second O-ring 36 against inner surfaces 18*a* and 18*b* of second chamber 18, respectively.

In the preferred embodiment, the top end of valve stem 30 includes a first engaging member 54 and the bottom end of valve stem 30 includes a second engaging member 56, both of which are positioned and sized to move valve body 32 in unison with valve stem 30. As piston 26 begins an exhaust stroke, valve stem 30 is movable a first selected distance without moving valve body 32. After valve stem 30 moves the first selected distance, first engaging member 54 contacts the upper surface of valve body 32 whereat the action of over-center springs 44 bias valve stem 30 toward the exhaust position thereby simultaneously moving valve body 32 to the second, venting position. Importantly, as the movement of valve stem 30 and valve body 32 is occurring, piston 26 continues to move through its exhaust stroke thereby discharging product from first chamber 16 through outlet check valve 52 and through product outlet 20*b*. As best seen in FIG. 2, when valve body 32 is moved to the second position (piston 26 having reached its full exhaust stroke), valve body 32 is operable to block off inlet 22*b* thereby creating an open passage from first chamber 18 through first passage 38 to outlet 22*a*. The blockage of inlet 22*a* is facilitated by the sealing of first O-ring 34 and second O-ring 36 against inner surfaces 18*b* and 18*c* of second chamber 18, respectively. When the pressurized gas is vented from second chamber 18, biasing spring 46 begins moving piston 26 through an intake stroke. When such occurs, valve stem 30 moves a second selected distance without moving valve body 32. After valve stem 30 moves the second selected distance, second engaging member 56 contacts the lower surface of valve body 32 whereat the action of over-center springs 44 bias valve stem 30 toward the intake position thereby simultaneously moving valve body 32 to the first, pressurizing position. Importantly, as piston 26 moves through its intake stroke, syrup is entering product inlet 20*a* and passing through check valve 50 into first chamber 16. As can be appreciated, the aforementioned process is repeated for subsequent cycles of piston 26.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. A fluid driven pump comprising:

a housing defining first and second interior chambers;

a piston shaft disposed within said housing for reciprocal movement therewithin;

a piston mounted to a first end of said piston shaft so as to be reciprocally movable through intake and exhaust strokes within said first chamber;

a gas inlet in fluid communication with said second chamber for inputting a pressurized gas into said second chamber;

a gas outlet in fluid communication with said second chamber for venting gas from said second chamber;

a valve assembly disposed within said second chamber, said valve assembly comprising:

an elongate, reciprocable valve stem having a first aperture extending longitudinally therethrough, said first aperture being sized and configured to slidably receive said piston shaft;

a valve body disposed about and slidably positionable along the length of said valve stem between first and second positions, said valve body including a first passage extending therethrough; and a valve member rigidly secured within said second chamber and including a second aperture extending therethrough sized and configured to slidably receive said valve body, said valve member further including a second passage extending therethrough;

over-center spring means rigidly secured within said second chamber, said over-center spring means being cooperatively engaged to said valve stem in a manner wherein said over-center spring means is operable to bias said valve body toward said first position when said piston travels through an intake stroke and reverse direction and bias said valve body toward said second position when said piston travels through an exhaust stroke; and a spring member disposed within said first chamber, said spring member being cooperatively engaged to said piston in a manner operable to move said piston through the intake stroke when said second chamber is vented via said gas outlet;

said valve body being operable to pressurize said second chamber via the flow of gas through said gas inlet and said second passage when in said first position and vent said second chamber via the flow of gas through said first passage and said gas outlet when in said second position.

2. The pump of claim 1 wherein said housing comprises:

a first housing section;

a second housing section rigidly connected to said first housing section; and a rolling diaphragm secured between said first and second housing sections and attached to said piston in a manner defining said first and second chambers.

3. The pump of claim 2 wherein said first housing section includes a product inlet for placing said first chamber in fluid communication with a product during said intake stroke of said piston and a product outlet for placing said first chamber in fluid communication with the product during said exhaust stroke of said piston.

4. The pump of claim 1 wherein said valve stem includes at least one engagement member formed on each of the opposed ends thereof for engaging and moving said valve body in unison with said valve stem.

5. The pump of claim 4 wherein said valve stem is movable a first selected distance during said exhaust stroke of said piston without moving said valve body, and said over-center spring means is operable to bias said valve stem toward an exhaust position after said valve stem has moved said first selected distance, said valve stem being operable to move said valve body to said second position when biased toward said exhaust position by said over-center spring means.

6. The pump of claim 5 wherein said valve stem is movable a second selected distance during said intake stroke of said piston without moving said valve body, and said over-center spring means is operable to bias said valve stem toward an intake position after said valve stem has moved said second selected distance, said valve stem being operable to move said valve body to said first position when biased toward said intake position by said over-center spring means.

7. The pump of claim 6 wherein said over-center spring means comprises at least one U-shaped torsion bar extending between said valve member and said valve stem.

8. The pump of claim 7 wherein said over-center spring means comprises two U-shaped torsion bars extending between said valve member and said valve stem.

* * * * *